US008052039B2

(12) United States Patent
Stepanek, Jr.

(10) Patent No.: US 8,052,039 B2
(45) **Date of Patent: *Nov. 8, 2011**

(54) INSULATED CUP

(75) Inventor: William Joseph Stepanek, Jr., Highland Heights, OH (US)

(73) Assignee: The Ovenable Paper Pan Company, LLC, Glenwillow, OH (US)

( * ) Notice: Subject to any disclaimer, the term of this patent is extended or adjusted under 35 U.S.C. 154(b) by 185 days.

This patent is subject to a terminal disclaimer.

(21) Appl. No.: 12/538,308

(22) Filed: Aug. 10, 2009

(65) Prior Publication Data

US 2009/0294520 A1 Dec. 3, 2009

Related U.S. Application Data

(63) Continuation of application No. 12/194,086, filed on Aug. 19, 2008, now Pat. No. 7,597,246, which is a continuation of application No. 11/203,892, filed on Aug. 15, 2005, now Pat. No. 7,451,911.

(60) Provisional application No. 60/603,428, filed on Aug. 20, 2004.

(51) Int. Cl.
*B65D 3/28* (2006.01)
*B65D 25/00* (2006.01)

(52) U.S. Cl. ..... 229/403; 220/739

(58) Field of Classification Search ..... 229/403; 383/110; 220/739, 4.03, 62.12, 62.2, 636, 220/592.26, 592.24, 592.16, 592.17, 640, 220/738; 215/370, 372, 376

See application file for complete search history.

(56) References Cited

U.S. PATENT DOCUMENTS

| | | | |
|---|---|---|---|
| 1,771,765 | A | 7/1930 | Benson |
| 2,661,889 | A | 12/1953 | Phinney |
| 3,082,900 | A | 3/1963 | Goodman |
| 4,147,836 | A | 4/1979 | Middleton et al. |
| 4,540,611 | A | 9/1985 | Henderson |
| 4,548,349 | A | 10/1985 | Tunberg |
| 5,145,107 | A | 9/1992 | Silver et al. |
| 5,205,473 | A | 4/1993 | Coffin, Sr. |
| 5,226,585 | A | 7/1993 | Varano |
| 5,393,292 | A | 2/1995 | Sand |
| 5,454,484 | A | 10/1995 | Chelossi |
| 5,524,817 | A | 6/1996 | Meier et al. |
| 5,665,295 | A | 9/1997 | Takamoto |
| 5,738,921 | A | 4/1998 | Andersen et al. |
| 5,752,653 | A | 5/1998 | Razzaghi |
| 5,967,875 | A | 10/1999 | Graef |
| 6,129,653 | A | 10/2000 | Fredricks et al. |
| 6,253,995 | B1 | 7/2001 | Blok |
| 6,290,091 | B1 | 9/2001 | Bell |
| 6,364,151 | B1 | 4/2002 | Gale |
| 6,422,456 | B1 | 7/2002 | Sadlier |
| 6,491,214 | B2 | 12/2002 | Plummer |
| 6,527,169 | B2 | 3/2003 | Kim |
| 7,056,563 | B2 | 6/2006 | Halabisky |
| 7,451,911 | B2 | 11/2008 | Stepanek, Jr. |
| 7,597,246 | B2 | 10/2009 | Stepanek, Jr. |
| 2002/0113072 | A1 | 8/2002 | Lane |
| 2003/0010817 | A1 | 1/2003 | Lingle |
| 2003/0226882 | A1 | 12/2003 | Porchia et al. |
| 2005/0048300 | A1 | 3/2005 | Mason |

FOREIGN PATENT DOCUMENTS

AU 199333903 A1 9/1993

*Primary Examiner* — Nathan J Newhouse
*Assistant Examiner* — Christopher Demeree
(74) *Attorney, Agent, or Firm* — Fay Sharpe LLP; Brian E. Turung

(57) ABSTRACT

An improved cup comprising a top portion and a base sleeve connected to the sidewall of the top portion. The base sleeve is at least partially formed of an insulating material. The base sleeve is formed of a one piece material that eliminates a seam at the bottom of the cup.

69 Claims, 2 Drawing Sheets

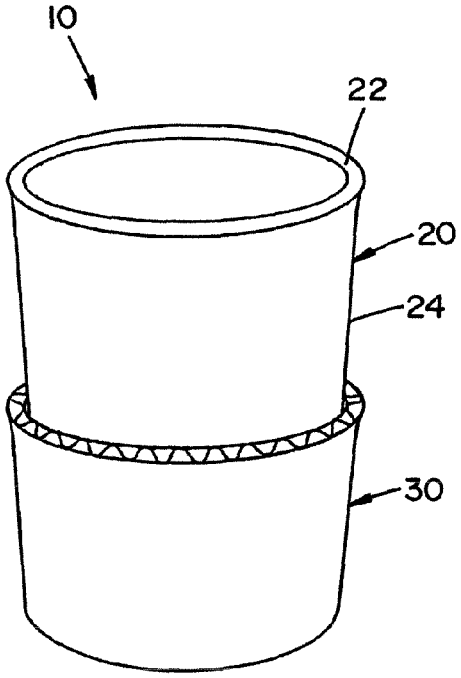
FIG. 1
FIG. 2
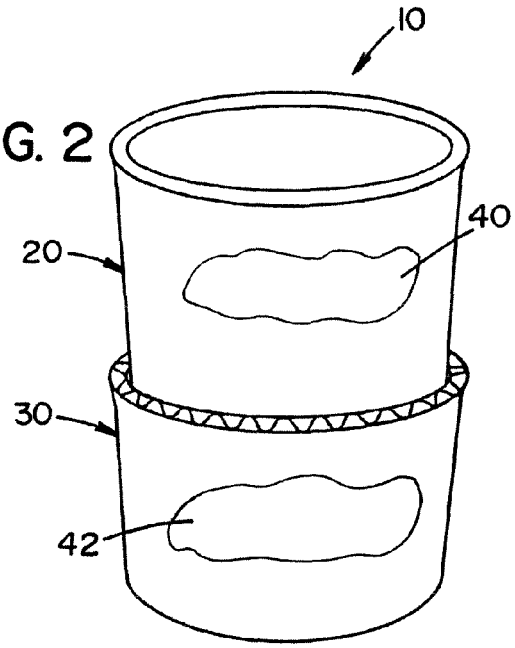
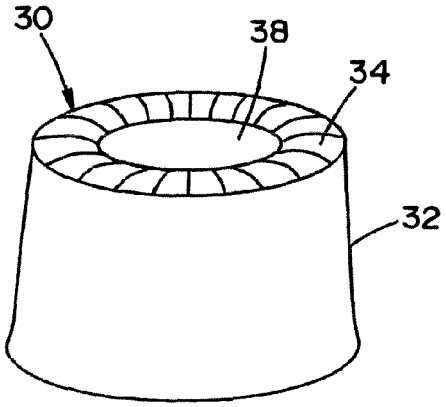
FIG. 4
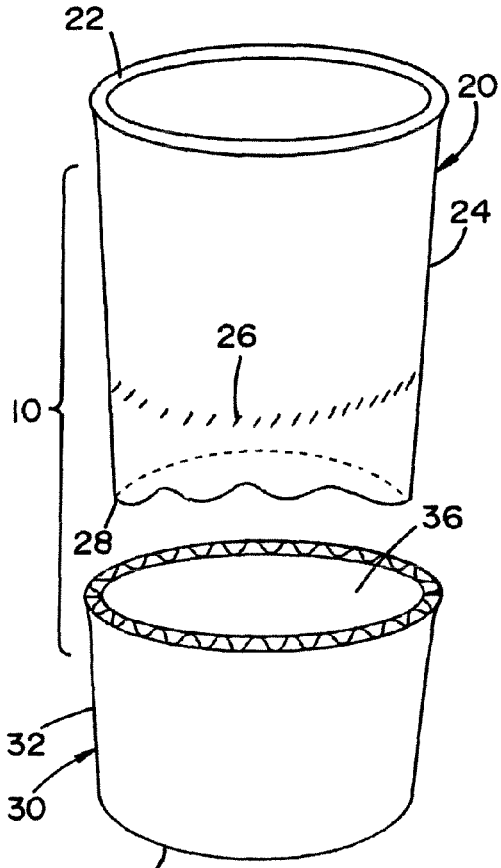
FIG. 3

INSULATED CUP

The present invention is a continuation application of U.S. patent application Ser. No. 12/194,086 filed Aug. 19, 2008 now U.S. Pat. No. 7,597,246, which in turn is a continuation of U.S. patent application Ser. No. 11/203,892 filed Aug. 15, 2005, now U.S. Pat. No. 7,451,911, which in turn claims priority on U.S. Provisional Application Ser. No. 60/603,428 filed Aug. 20, 2004, which is incorporated herein by reference.

The invention relates generally to containers, and more particularly to cups, and even more particularly to paper cups that are designed to contain warm or hot liquids.

BACKGROUND OF THE INVENTION

Currently in the marketplace there is a need for a cost competitive paper cup that will reduce or prevent burns when an individual holds a cup of hot liquid such as coffee, tea, hot chocolate and the like. There is also a need in the marketplace for a cost competitive paper hot cup that will not leak or will resist leaking when filled with warm and hot liquids.

Various types of paper cups have been developed to address the problem associated with discomfort or injury from warm or hot liquids in a paper cup. Some cups have been developed to insulate the user from the hot liquid such as in U.S. Pat. Nos. 6,129,653; 5,752,653; 5,454,484; 5,226,585; 5,145,107; and 4,548,349; or by forming a handle on the paper cup such as in U.S. Pat. Nos. 6,527,169 and 5,393,292, all of which are incorporated herein by reference.

Today's hot cup market is a highly competitive market. Unfortunately, there is currently no good solution to the insulation/burn problem. Many manufacturers have tried wrapping corrugated materials around the paper cup in the form of jackets (called java jackets) and have, in some instances secured the corrugated material to the paper cup by an adhesive. All these previous designs have been unacceptable since such designs failed to reach a desired cost level of one and a half times the cost of a standard hot cup (also the equivalent to the cost of a regular cup plus a java jacket). One of the better hot-cup designs available is a 16 oz. Insulair cup made by International Paper. The Insulair cup is formed by melting a polymeric coating around the outside of the cup. The coating material crystallizes and forms a satisfactory-looking cup. One of the problems with this cup is that the cup does a poor job of insulating a user from hot liquids that are in the cup. The Insulair cup only cuts down on the outer temperature of the cup, and does nothing to prevent leaks that can occur at the base of the cup.

There are over 1 billion hot cups per year served at Starbucks alone. These cups include a mandatory java jacket; however, these cups still occasionally leak through the bottom. Other companies such as Caribou Coffee also require that its stores insert a corrugated sleeve on every paper cup served that contains warm or hot liquid. Some companies also insert a corrugated sleeve on paper cups that include cold liquid such as iced coffee, smoothies, etc. The use of the corrugated sleeve prevents injury and/or reduces discomfort when a user picks up the paper cup. The inclusion of the corrugated sleeve on the cup adds a raw material cost and requires the company to monitor and maintain additional inventory, thereby reducing profit margins. The insertion of the corrugated sleeve on the paper cup also increases labor costs for the time spent properly inserting the corrugated sleeve on the paper cup, thereby further reducing profit margins. The failure of an employee to insert or to properly insert the corrugated sleeve on the paper cup can result in injury to a consumer.

Even with the use of the corrugated sleeve on the paper cup, the paper cup is still susceptible to leakage of hot liquid. The hot liquid in the paper cup tends to melt, soften and/or degrade the adhesive that secures the bottom of the paper cup to the sidewall of the paper cup, thereby resulting in the liquid leaking from the base of the paper cup. The leakage of the liquid from the paper cup onto a consumer can result in injury to the consumer when the warm or hot liquid leaks from the bottom of the paper cup. The leaking of liquid from the paper cup can also result in damage/staining to a surface upon which the paper cup rests and/or on other surfaces (e.g., floor, clothing, vehicle, etc.).

When cold liquids are inserted in a paper cup, condensation begins to form on the outer surface and base of the paper cup. This is commonly referred to as sweating. Over time, enough condensation forms to cause water to run down the side of the paper cup and form a water stain around the paper cup. Such staining can damage a surface or cause undesirable staining of clothing or other absorbent materials.

In view of the existing problems associated with paper cups, there is a need for an improved paper cup that 1) protects a user from injury or discomfort from the warm, hot or cold liquids in the paper cup, 2) reduces the incidence of leakage from the paper cup, and/or 3) which reduces sweating problems associated with use of a paper cup.

SUMMARY OF THE INVENTION

The invention generally relates to containers, and more particularly to cups, and even more particularly to paper cups. With regard to paper cups, the invention generally relates to traditional paper cups; however, it will be appreciated that the invention is applicable for use with other types of cups such as, but not limited to, plastic cups, foam cups, etc. Although the invention will be particularly described with respect to a cup; it will be appreciated that the invention has much broader applications, thus can be used in conjunction with other types of containers such as, but not limited to, boxes (e.g., pizza boxes, etc.), food containers (e.g., carry-out food containers, etc.) that are used to contain hot/cold liquids and/or foods, or other materials.

Traditional paper cups include a paper sidewall that has a seam that runs along the longitudinal length or height of the paper cup. A paper bottom is glued to the paper sidewall to retain liquids within the paper cup. The top edge of the cup can include a rim such as, but not limited to, an outwardly rolled rim. The paper material that forms the cup can include a coating material to reduce the absorbency of the paper material. The size of the paper cup is typically a 12 oz. or 16 oz. cup; however, other sizes can be used.

The present invention deviates from past paper cup designs by eliminating the traditional base that is adhesively connected to the bottom of the cup. In one non-limiting embodiment of the invention, the glued paper bottom of traditional cups is eliminated and substituted with a base sleeve. The base sleeve is designed to cover and/or form the bottom of the cup and extends at least partially up the outer surface/inner surface of the sidewall of the cup. The base sleeve can thus extend partially or fully up the side of the cup. In one non-limiting design, the base sleeve extends at least about 5% up the side of the cup. In another non-limiting design, the base sleeve extends at least about 10% up the side of the cup. In still another non-limiting design, the base sleeve extends at least about 25% up the side of the cup. In yet another non-limiting design, the base sleeve extends at least about 50% up the side of the cup. In still yet another non-limiting design, the base sleeve extends over a majority up the side of the cup. In a further non-limiting design, the base sleeve extends at least about 75% up the side of the cup. In still a further non-limiting design, the base sleeve extends about 100% up the side of the cup. The size of the base sleeve is generally selected to extend at least about 0.5-1 inches upwardly from the base of the cup; however, this is not required. In one non-limiting design, the base sleeve extends at least about 1-5 inches upwardly from the base of the cup. In another and/or alternative non-limiting design, the base sleeve extends upwardly from the base of the cup a distance sufficient to a) enable a company to include logo or print advertising on the cup that does not include the base sleeve, b) enable product information to be printed on the paper that does not include the base sleeve, c) enable a company to include logo or print advertising on the base sleeve, d) enable product information to be printed on the base sleeve, and/or e) enable a user to grasp the base sleeve when drinking from the cup. In one specific non-limiting design, the base sleeve extends about 2-5 inches upwardly from the base of the cup.

In one non-limiting aspect of the present invention, the base sleeve can be at least partially formed of a corrugated material. In one non-limiting design, the base material is formed of a majority of corrugated material. The corrugated material is generally coated with a material that reduces or eliminates moisture absorption. In one non-limiting design, the corrugated material is generally a poly-coated material (e.g., Low Density Polyethylene (LDPE) Resins, Linear Low Density Polyethylene (LLDPE) Resins, Ultra Low Density Polyethylene (ULDPE) Resins, etc.); however, it can be appreciated that other or additional materials can be used. The corrugated material is a paper or cardboard material of about two-three sheets of 26-42 lb. (per thousand square feet) material; however, other material weights and/or other number of sheets can be used. The corrugated material is typically an F-flute (commonly referred to as a micro-flute) or E-flute material; however, other materials and flute profiles can be used. The base sleeve can be at least partially formed from a blank of corrugated material that is cut by cutting dies or other types of cutters; however, this is not required.

In another and/or alternative non-limiting aspect of the present invention, the base sleeve can be cup-shaped; however, it will be appreciated that the base sleeve can have other shapes. The base sleeve can be formed from a generally flat piece of corrugated material by inserting the corrugated material into a die and then pressing the corrugated material into the desired shape; however, this is not required. As can be appreciated, the base sleeve can be formed by a thermal forming process; however, other or additional processes can be used. One non-limiting process for forming the base sleeve includes a) cutting a blank of corrugated material from a corrugated sheet, and b) press forming the cut blank into a cup-shaped base sleeve by use of a die. The cutting of the blank from the corrugated sheet can be made by a die-cutting process; however, this is not required. Typically a mass production line is used to form the base sleeve; however, this is not required.

In still another and/or alternative non-limiting aspect of the present invention, the base sleeve can be designed to be secured to the sidewall of the cup when the base sleeve does not fully form the side of the cup. In one non-limiting embodiment, the base sleeve is designed to fully or partially telescopically receive the sidewall of the cup. In one non-limiting design, the base sleeve is designed such that the sidewall of the cup extends into the base sleeve about 90-100% of the longitudinal length of the base sleeve. In another non-limiting design, the base sleeve is designed such that the sidewall of the cup extends into the base sleeve less than 90% (e.g., 5%, 10%, 20%, 25%, 30%, 40%, 50%, 60%, etc.) of the longitudinal length of the base sleeve. In another non-limiting embodiment, the sidewall of the cup is designed to fully or partially telescopically receive the base sleeve. In one non-limiting design, the base sleeve is designed such that the sidewall of the cup telescopically receives about 90-100% of the longitudinal length of the base sleeve. In another non-limiting design, the base sleeve is designed such that the sidewall of the cup telescopically receives less than 90% (e.g., 5%, 10%, 20%, 25%, 30%, 40%, 50%, 60%, etc.) of the longitudinal length of the base sleeve.

In yet another and/or alternative non-limiting aspect of the present invention, the base sleeve can be at least partially secured to the sidewall of the cup by the use of a leak-resistant adhesive; however other or additional connection arrangements could be used (e.g., heat created seal, sealing ring, etc.). The side wall is generally formed of a paper or cardboard material; however, other or additional materials can be used. In one non-limiting embodiment, the base sleeve is adhesively secured to the sidewall of the cup after the sidewall of the cup is formed. In one non-limited embodiment, the sidewall of the cup can be formed by a PMC Cup Machine. In such a process, the sidewall of the cup is formed on a mandrel. During or after the sidewall is formed on the mandrel of the cup machine, an adhesive is applied to the bottom portion of the side wall. The adhesive is typically applied around the complete perimeter of the cup. The adhesive can be applied to the bottom portion of the sidewall in a manner to cover the desired amount of the outer surface of the side wall. Additionally or alternatively, an adhesive is applied to at least a portion of the inside surface of the base sleeve. After the adhesive has been applied, at least a portion of the sidewall is inserted into the base sleeve to be secured to the bottom portion of the sidewall of the cup to the base sleeve. In another non-limited embodiment, the sidewall of the cup can be formed by a PMC Cup Machine; however, it will be appreciated that other processes can be used to form the cup of the present invention. In a process that uses a PMC Cup Machine, the sidewall of the cup is formed on a mandrel. During or after the sidewall is formed on the mandrel of the cup machine, an adhesive is applied to the inside bottom portion of the side wall. In addition or alternatively, an adhesive is applied to at least a portion of the outside surface of the base sleeve. After the adhesive as been applied, the base sleeve is at least partially inserted into and secured to the bottom portion of the sidewall of the cup. The adhesive, when applied to the sidewall, is typically applied around the complete perimeter of the inner or outer surface of the sidewall. The adhesive, when applied to the base sleeve, is typically applied around the complete perimeter of the inner or outer surface of the base sleeve. The adhesive can be applied to the sidewall and/or base sleeve in the amount and/or location that is desired and/or needed to properly secure the base sleeve to the sidewall of the cup. The adhesive between the sidewall and the base sleeve is not subject to direct contact of the liquids in the cup when the base sleeve is designed to at least partially telescopically receive a portion of the sidewall of the cup. As such, the adhesive is better able to resist degrading, thereby extending the usable life of the cup.

In still yet another and/or alternative non-limiting aspect of the present invention, the base sleeve can include a lip. The lip on the base sleeve can be used to enable a user to better grasp the cup. The lip can also or alternatively be used to at least partially protect the user from hot/cold liquids seeping down the outer side surface of the cup.

In a further and/or alternative non-limiting aspect of the present invention, the base sleeve can include a recessed portion in the bottom of the base sleeve; however, this is not required. The recessed bottom can be used to provide improved cup stability when the cup is placed on a flat surface. As can be appreciated, the recess can have other or additional functions.

The use of the base sleeve on the cup, especially a paper cup, results in many advantages over traditional paper cups. These advantages include, but are not limited to:

- Achieving better maintenance of the temperature of the beverage in the cup for longer time periods. As such, beverages in the cup stay hotter or colder for longer time periods, thereby improving the satisfaction of the user.
- Providing insulation to the fingers or the hand of a user from the temperature of the liquid in the cup. As such, if the sidewall of the cup is too hot or cold, the user can simply grasp the base sleeve; thereby improving the enjoyment value of the beverage in the cup and/or reducing discomfort and/or injury to the user.
- Creating a cup that is virtually leak proof. The base sleeve eliminates the small region of adhesive at the base of the cup thereby significantly reducing or eliminating the incidence of leakage of liquid from the base of the cup, even after long periods of time.
- Maintaining room for graphics on the top portion of the cup. Present day java jackets cover a significant portion of the mid-region of the cup which is typically the region that includes graphic and/or printed information (e.g., product information, marketing information, etc.). The base sleeve can be designed to allow room for graphics on the sidewall of the cup that extend above the base sleeve.
- Increasing the strength of the cup. The use of the base sleeve can increase the strength and/or durability of the cup.
- Providing protection from hot/cold liquids running down the side of the sidewall of the cup. The base sleeve can include a lip to provide some protection to a user from hot/cold liquids seeping down the outer side surface of the cup.
- Providing better handling of the cup. The base sleeve can include a lip and/or textured surface to enable a user to better grasp the cup.
- Providing protection to surfaces on which the cup is placed. The base sleeve enables the cup to be placed on wood surfaces or other temperature sensitive surfaces, thereby at least partially protecting such surfaces from damage and/or discoloration. The base sleeve at least partially functions similarly to a coaster on such surfaces.
- Reducing the amount of sweating on the cup. The base sleeve can reduce the amount of sweating on the exterior and base of the cup, thereby enabling the cup to be placed on wood surfaces or other moisture sensitive surfaces.

In a further and/or alternative non-limiting aspect of the present invention, the base sleeve forms 90-100% of the cup. The base sleeve of the present invention can be used to form an essentially leak proof cup by eliminating the seams necessary on a traditional cup and/or glued paper on the base of the cup. The one-piece base sleeve eliminates the seams and adhesion problems of past paper cut designs. The selection of materials of the base sleeve can also be used to significantly inhibit or prevent liquids from penetrating through the base sleeve. The use of the base sleeve for forming 90-100% of the cup results in many advantages over traditional paper cups. These advantages include, but are not limited to:

- Achieving better maintenance of the temperature of the beverage in the cup for longer time periods. As such, beverages in the cup stay hotter or colder for longer time periods, thereby improving the satisfaction of the user.
- Providing insulation to the fingers or the hand of a user from the temperature of the liquid in the cup. As such, if the sidewall of the cup is too hot or cold, the user can simply grasp the base sleeve; thereby improving the enjoyment value of the beverage in the cup and/or reducing discomfort and/or injury to the user.
- Creating a cup that is virtually leak proof. The base sleeve eliminates the small region of adhesive at the base of the cup thereby significantly reducing or eliminating the incidence of leakage of liquid from the base of the cup, even after long periods of time. The use of the one-piece base sleeve to form the cup also eliminates the use of a side seam and thus extends the life of the cup and essentially eliminates leakage through the side of the cup. The one-piece cup is thus essentially leak-proof, since the adhesive seams are eliminated.
- Allowing for unobstructed graphics to be used on the side of the cup. Present day java jackets cover a significant portion of the mid-region of the cup which is typically the region that includes graphic and/or printed information (e.g., product information, marketing information, etc.). The cup that is formed of the base sleeve does not require a java jacket or similar jacket, thus information and graphics can be printed on the side of the cup without concern of being obstructed by a java jacket or similar jacket. As such, the base sleeve can include graphics, colors, etc. anywhere on the base sleeve.
- Increasing the strength of the cup. The use of the base sleeve can increase the strength and/or durability of the one-piece cup.
- Providing protection from hot/cold liquids running down the side of the sidewall of the cup. The base sleeve can include a lip to provide some protection to a user from hot/cold liquids that spill over the lip of the cup.
- Providing better handling of the cup. The base sleeve can include a lip and/or textured surface to enable a user to better grasp the cup.
- Providing protection to surfaces on which the cup is placed. The base sleeve enables the cup to be placed on wood surfaces or other temperature sensitive surfaces, thereby at least partially protecting such surfaces from damage and/or discoloration. The base sleeve at least partially functions similarly to a coaster on such surfaces.
- Reducing the amount of sweating on the cup. The base sleeve can reduce the amount of sweating on the exterior and base of the cup, thereby enabling the cup to be placed on wood surfaces or other moisture sensitive surfaces.

It is one non-limiting object of the present invention to provide an improved cup.

It is another and/or alternative non-limiting object of the present invention to provide a cup that reduces or eliminates the incidence of leakage of liquid from the base of the cup.

It is still another and/or alternative non-limiting object of the present invention to provide a cup that improves the maintenance of the temperature of the beverage in the cup for longer time periods.

It is yet another and/or alternative non-limiting object of the present invention to provide a cup that provides insulation to the fingers or the hand of a user from the temperature of the liquid in the cup thereby reducing discomfort and/or injury to the user.

It is still yet another and/or alternative non-limiting object of the present invention to provide a cup that provides room for graphics on the cup.

It is a further and/or alternative non-limiting object of the present invention to provide a cup that does not require a java jacket to reduce discomfort and/or injury to the user due to hot/cold liquids in the cup.

It is still a further and/or alternative non-limiting object of the present invention to provide a cup that has increased strength and/or durability.

It is yet a further and/or alternative non-limiting object of the present invention to provide a cup that reduces or prevents damage to hot/cold sensitive surfaces.

It is still yet a further and/or alternative non-limiting object of the present invention to provide a cup that reduces the amount of sweating on the cup.

These and other advantages will become apparent to those skilled in the art upon the reading and following of this description taken together with the accompanying drawings.

BRIEF DESCRIPTION OF THE DRAWINGS

Reference may now be made to the drawings, which illustrate various embodiments that the invention may take in physical form and in certain parts and arrangements of parts wherein:

FIG. 1 is a cup that includes a base sleeve in accordance with the present invention;

FIG. 2 is the cup as illustrated in FIG. 1 which includes graphics;

FIG. 3 is an exploded view of the cup of FIG. 1;

FIG. 4 illustrates one non-limiting embodiment of a base sleeve in accordance with the present invention;

DETAILED DESCRIPTION OF THE INVENTION

Figure 5:
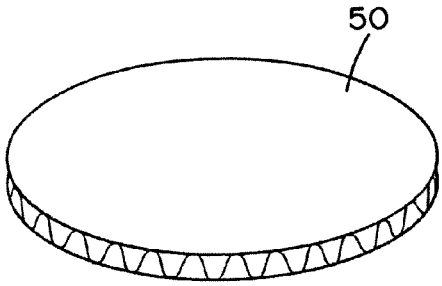
FIG. 5 is a cut blank of the base sleeve.

Referring now to the drawings wherein the showings are for the purpose of illustrating embodiments of the invention only and not for the purpose of limiting the same, FIG. 1 illustrates one non-limiting arrangement for the cup of the present invention. The cup 10 illustrated in FIG. 1 is an 8-16 ounce cup; however, it will be appreciated that other sized cups can be used. The cup 10 includes a top portion 20 and a base sleeve 30. The top portion 20 and base sleeve 30 are illustrated in FIG. 3 as being detached from one another. Top portion 20 is illustrated as having a generally circular cross-section shape; however, it will be appreciated that other cross-sectional shapes can be used (e.g., polygonal, oval, etc.). The top portion is also shown to have a varying diameter along the longitudinal axis of the top portion; however, it can be appreciated that the top portion can be designed such that the diameter does not vary along the longitudinal axis. Top portion 20 is also shown to have a generally constant wall thickness 22; however, this is not required. The top portion is generally made of a paper or cardboard material; however, other materials can be used (e.g., plastic, metal glass, etc.).

As illustrated in FIGS. 1 and 3, top portion 20 is designed to be received in base sleeve 30. Base sleeve 30 is shown to be formed of a single piece of corrugated material such as an E-flute material; however, other materials and flute profiles can be used. The corrugated material is a paper or cardboard material of about two-three sheets of 26-42 lb. (per thousand square feet) material; however, other material weights and/or other number of sheets can be used. The base portion includes a side wall 32 and a base 34 which define a central cavity 36. Central cavity 36 has a size and shape that closely matches the size and shape of the lower portion of top portion 20 so that the lower portion of top portion 20 is telescopically inserted into cavity 36. Since base cavity 30 is formed of a single piece of material, the base sleeve does not include any seams. The base sleeve is typically coated with sealing material such as, but not limited to, a poly-coated material (e.g., Low Density Polyethylene (LDPE) Resins, Linear Low Density Polyethylene (LLDPE) Resins, Ultra Low Density Polyethylene (ULDPE) Resins, etc.); however, it can be appreciated that other or additional materials can be used. The sealing material is used to reduce or prevent moisture absorption by the material forming the base sleeve. Top portion 20 also typically includes a sealing material to reduce or prevent moisture absorption by the material forming the base sleeve when the top portion is formed of a moisture absorbing material (e.g., paper, cardboard, etc.). Base 34 of the base sleeve can have a generally flat surface or a recessed portion 38 as shown in FIG. 4.

As illustrated in FIG. 3, the sidewall 24 of top portion 20 includes an adhesive 26. Adhesive 26 is used to secure the base sleeve 30 to the top portion 20 once the lower portion of the top portion is inserted into cavity 36 of base sleeve 30. Adhesive 26 can also be used to form a liquid tight seal between top portion 20 and base sleeve 30. Top portion 20 is shown to be absent a base since the base sleeve functions as the base of the cup once the top portion and base sleeve are connected together. Typically, the bottom edge 28 of the top portion is inserted into the cavity of the base sleeve until the bottom edge contacts the top surface of bottom 34; however, this is not required. As shown in FIG. 3, at least a portion of adhesive 26 is spaced from bottom edge 28. As such, the region of the adhesive that is spaced from the bottom edge is not at least partially shielded from direct contact with liquids inserted in the cup, thus the rate at which the adhesive degrades while liquids are contained in the cup is significantly slower than in traditionally designed cups. Typically, about 10-100 percent of the adhesive is spaced from the bottom edge of the cup, and more typically about 30-100 percent of the adhesive is spaced from the bottom edge of the cup.

Referring now to FIG. 2, there is illustrated a cup 10 that is similar to the cup of FIG. 1. As shown in FIG. 2, the top portion 20 and the base sleeve 30 includes printed material or labels 40, 42 respectively. The printed material or labels can include product information, advertising, etc. As can be appreciated, the top portion or the base sleeve can be absent printed material or labels. As shown in FIG. 2, the base sleeve extends upwardly along the sidewall of the top portion a distance that enables a user to conveniently grasp of the cup, yet provides sufficient room on the top portion to enable printed material and/or labels to be inserted on the sidewall to be viewed by a user. Typically, the base sleeve extends upwardly along about 10-60% of the sidewall; however other distances can be used. In one non-limiting design, the cup is a 12 ounce cup that includes a base sleeve that extends about 3 inches upwardly from the bottom of the cup. The exposed top portion extends 3-6 includes about the top edge of the base sleeve. The base sleeve is large enough to enable a user to grasp the bottom portion of the cup to thereby insulate the user from the temperature of the liquid in the cup. The base sleeve is small enough to enable graphics on the upper portion of the sidewall of the cup to be displayed. As can be appreciated, graphics, color, etc. can also or alternatively be included on the base sleeve if desired.

Figure 6:
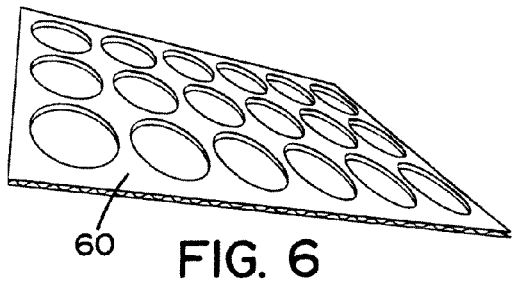
FIG. 6 is a sheet of material that has been cut to form a plurality of the blanks of FIG. 5.
Figure 7:
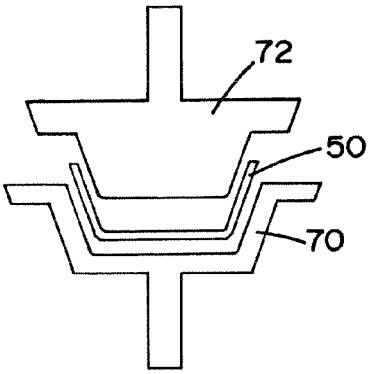
FIG. 7 illustrates one non-limiting process used to form a cut blank into a formed base sleeve.
Figure 9:
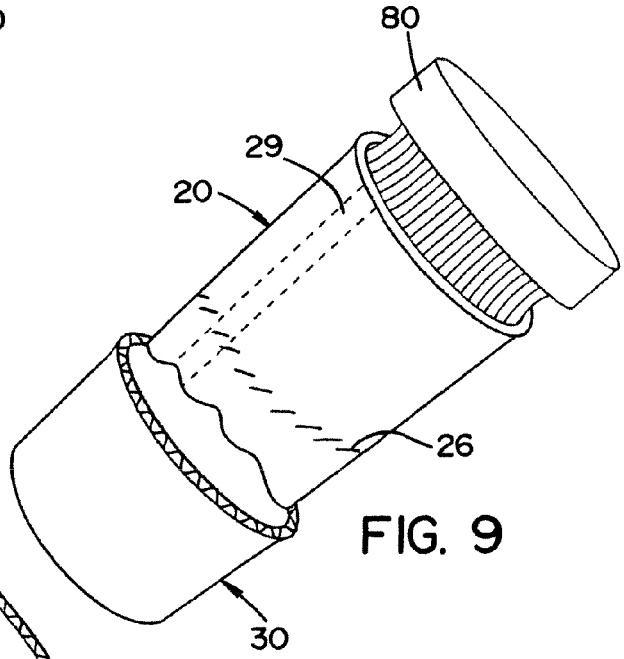
Figure 8:
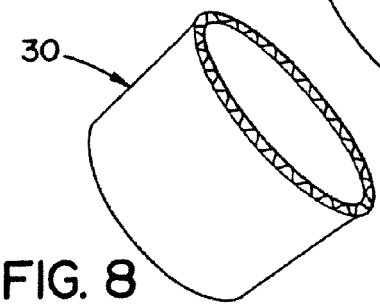
FIG. 8 illustrates one non-limiting embodiment of a base sleeve that is formed by the process of FIG. 7; and, FIG. 9 illustrates one limiting process for forming the cup in accordance with the present invention.

Referring now to FIGS. 5-9, one non-limiting process for forming cup 10 is shown. FIG. 5 illustrates a blank 50 which has been cut from a sheet 60 of corrugated material as shown in FIG. 6. Typically, blank 50 is cut out from sheet 60 by use of a die-cut process; however, other cutting processes can be used. After the blank has been cut from the sheet, the blank can be formed into base sleeve 30 by a forming process such as, but not limited to, a thermo-press process as illustrated in FIG. 7. In a thermo-press process, blank 50 is inserted into a lower die portion 70. Thereafter, an upper die portion 72 and the lower die portion are moved into engagement with one another to cause the blank to conform to a particular shape. During the forming process, heat is applied to blank 50 to facilitate in the setting of the blank into its new shape. Once the base sleeve has been formed, the sleeve is removed from the die as shown in FIG. 8. As can be appreciated, base sleeve can form the complete cup or only form the base portion of the cup as illustrated in FIGS. 1 and 2. When the base sleeve is designed to form the base portion of the cup, the base sleeve 30 is inserted onto the lower portion of top portion 20 as shown in FIG. 9. As shown in FIG. 9, top portion 20 is formed and spun on a mandrel 80 such as on a PMC cup machine. As can be appreciated, top portion 20 can be formed by other processes. During the forming process, two edges of the top portion are connected together by an adhesive or other means (e.g., hot melting etc.) to form a side seam 29 that extends along the longitudinal axis of the top portion. As the top portion is spun on the mandrel, a glue applicator, not shown, applies an adhesive 26 on sidewall 24 of top portion 20. After adhesive 26 is applied to the sidewall, a base sleeve is inserted onto the lower portion of the top portion. Adhesive 26, upon drying, secures the base sleeve to the top portion and forms a liquid tight seal between a portion of sidewall 24 and a portion of the inner surface of cavity 36 of base sleeve 30.

It will thus be seen that the objects set forth above, among those made apparent from the preceding description, are efficiently attained, and since certain changes may be made in the constructions set forth without departing from the spirit and scope of the invention, it is intended that all matter contained in the above description and shown in the accompanying drawings shall be interpreted as illustrative and not in a limiting sense. The invention has been described with reference to preferred and alternate embodiments. Modifications and alterations will become apparent to those skilled in the art upon reading and understanding the detailed discussion of the invention provided herein. This invention is intended to include all such modifications and alterations insofar as they come within the scope of the present invention. It is also to be understood that the following claims are intended to cover all of the generic and specific features of the invention herein described and all statements of the scope of the invention, which, as a matter of language, might be said to fall therebetween.

I claim:

1. An insulated cup comprising a top portion and a base sleeve that forms a bottom of the cup;

said top portion having a side wall, a top, a bottom, a top opening, a bottom opening and a cavity extending from said top opening to said bottom opening, said side wall of said top portion having an outer surface; and, said base sleeve including abuse, a side wall extending upwardly from said base, an upper opening and a sleeve cavity extending from an upper surface of said base to said upper opening, said upper surface at least partially forming an inner surface of said cup and a bottom surface of said cup such that when liquid is contained in said cup the liquid directly contacts said upper surface of said base of said base sleeve, said sleeve cavity having an interior surface that is absent a seam, at least a portion of said interior surface of said sleeve cavity at least partially forming said inner surface of said cup, said base sleeve fitted onto said bottom of said top portion so that said sleeve cavity of said base sleeve at least partially telescopically receives said side wall of said top portion and covers and seals said bottom opening of said top portion, said side wall of said base sleeve forming a portion of an outer surface of said cup to enable a user to grasp said side wall of said base sleeve and thereby insulate the user from a temperature of the liquid in said cup, at least a portion of said interior surface of said sleeve cavity connected to at least a portion of said outer surface of said side wall of said top portion, said connection between said base sleeve and said top portion forming a liquid proof seal, said liquid proof seal at least partially formed between said interior surface of said sleeve cavity and said outer surface of said side wall of said top portion, said interior surface of said sleeve cavity at least partially connected to said outer surface of said side wall of said top portion by an adhesive or heat created seal, said liquid proof seal at least partially formed by said adhesive or said heat created seal.

2. The insulated cup as defined in claim 1, wherein said base sleeve is formed of a different material from said top portion.

3. The insulated cup as defined in claim 1, wherein said base sleeve is formed of the same material as said top portion.

4. The insulated cup as defined in claim 1, wherein said base sleeve includes a multilayer material, said multilayer material including at least one layer of corrugated paper or corrugated cardboard material.

5. The insulated cup as defined in claim 1, wherein said side wall of said base sleeve extends upwardly from said bottom of said top portion to at least about 5% of a longitudinal length of said side wall of said top portion.

6. The insulated cup as defined in claim 5, wherein said side wall of said base sleeve extends upwardly less than the complete longitudinal length of said side wall of said top portion.

7. The insulated cup as defined in claim 6, wherein said cup has a longitudinal length, said base sleeve has a longitudinal length that is about 10-60 percent of the longitudinal length of said cup.

8. The insulated cup as defined in claim 7, wherein said side wall of said base sleeve extends upwardly from said bottom of said top portion to at least about 25% of a longitudinal length of said side wall of said top portion.

9. The insulated cup as defined in claim 8, wherein said side wall of said base sleeve extends upwardly from said bottom of said top portion to at least about 50% of a longitudinal length of said side wall of said top portion.

10. The insulated cup as defined in claim 6, wherein said side wall of said base sleeve extends upwardly at least about 0.5 inches and up to about 5 inches up said side wall of said top portion.

11. The insulated cup as defined in claim 1, wherein said side wall of said top portion is telescopically received into at least about 90% of a longitudinal length of said sleeve cavity of said base sleeve.

12. The insulated cup as defined in claim 1, wherein a majority of said liquid proof seal is positioned above a bottom edge of said bottom of said top portion.

13. The insulated cup as defined in claim 12, wherein all of said liquid proof seal is positioned above said bottom edge of said bottom of said top portion so that liquid in said insulated cup does not contact said liquid proof seal at said bottom surface of said cup.

14. The insulated cup as defined in claim 1, wherein said side wall of said top portion having a circular cross-sectional shape that varies in cross-sectional area along a longitudinal length of said top portion, said sleeve cavity of said base sleeve having a circular cross-sectional shape that varies in cross-sectional area along a longitudinal length of said base sleeve, said sleeve cavity of said base sleeve having a similar cross-sectional shape to said cross-sectional shape of said side wall of said top portion in the region where said base sleeve and said top portion are connected together.

15. The insulated cup as defined in claim 1, wherein said base of said base sleeve includes a recessed portion which forms a recess in said bottom of said cup.

16. The insulated cup as defined in claim 1, wherein said base sleeve includes a coating of a sealing material.

17. The insulated cup as defined in claim 1, wherein said insulated cup is a 8-16 ounce cup.

18. The insulated cup as defined in claim 1, wherein said insulated cup consists of only said top portion and said base sleeve.

19. The insulated cup as defined in claim 1, wherein said top of said top portion includes a rolled rim.

20. The insulated cup as defined in claim 1, wherein said base sleeve is formed of a single piece of material that includes paper or cardboard material.

21. The insulated cup as defined in claim 20, wherein said base sleeve is formed a material that includes corrugated paper or corrugated cardboard material.

22. The insulated cup as defined in claim 1, wherein said top portion including a paper or cardboard material.

23. An insulated cup comprising a top portion and a base sleeve that forms a bottom of the cup;

said top portion having a side wall, a top, a bottom, a top opening, a bottom opening and a cavity extending from said top opening to said bottom opening, said side wall of said top portion having an outer surface, said top portion including a side liquid-proof seam at least partially along a longitudinal length of said side wall of said top portion; and, said base sleeve including a base, a side wall extending upwardly from said base, an upper opening and a sleeve cavity extending from an upper surface of said base to said upper opening, said upper surface of said base sleeve at least partially forming an inner surface of said cup, said sleeve cavity having an interior surface that is absent a seam, at least a portion of said interior surface of said sleeve cavity at least partially forming said inner surface of said cup, said base sleeve fitted onto said bottom of said top portion so that said sleeve cavity of said base sleeve at least partially telescopically receives said side wall of said top portion and covers and seals said bottom opening of said top portion, said side wall of said base sleeve extending upwardly from said bottom of said top portion to at least about 5% of said longitudinal length of said side wall of said top portion, at least a portion of said interior surface of said sleeve cavity connected to at least a portion said outer surface of said side wall of said top portion, said connection between said base sleeve and said top portion forming a liquid proof seal, said liquid proof seal at least partially formed between said interior surface of said sleeve cavity and said outer surface of said side wall of said top portion, said interior surface of said sleeve cavity at least partially connected to said outer surface of said side wall of said top portion by an adhesive or heat created seal, said liquid proof seal at least partially formed by said adhesive or said heat created seal.

24. The insulated cup as defined in claim 23, wherein said side wall of said top portion having a circular cross-sectional shape that varies in cross-sectional area along a longitudinal length of said top portion, said sleeve cavity of said base sleeve having a circular cross-sectional shape that varies in cross-sectional area along a longitudinal length of said base sleeve, said sleeve cavity of said base sleeve having a similar cross-sectional shape to said cross-sectional shape of said side wall of said top portion in the region where said base sleeve and said top portion are connected together.

25. The insulated cup as defined in claim 24, wherein said side wall of said base sleeve extends upwardly less than a complete longitudinal length of said side wall of said top portion.

26. The insulated cup as defined in claim 25, wherein said base sleeve includes a coating of a sealing material.

27. The insulated cup as defined in claim 26, wherein at least a portion of said liquid proof seal is positioned above a bottom edge of said bottom of said top portion.

28. The insulated cup as defined in claim 27, wherein said top of said top portion includes a rolled rim.

29. The insulated cup as defined in claim 28, wherein said base of said base sleeve includes a recessed portion which forms a recess in said bottom of said cup.

30. The insulated cup as defined in claim 29, wherein said base sleeve and said top portion includes a paper or cardboard material.

31. The insulated cup as defined in claim 30, wherein said base sleeve includes at least one layer of corrugated material.

32. The insulated cup as defined in claim 31, wherein said insulated cup consists of only said top portion and said base sleeve.

33. The insulated cup as defined in claim 30, wherein said insulated cup consists of only said top portion and said base sleeve.

34. The insulated cup as defined in claim 23, wherein said side wall of said base sleeve extends upwardly less than a complete longitudinal length of said side wall of said top portion.

35. The insulated cup as defined in claim 23, wherein said base sleeve includes a coating of a sealing material.

36. The insulated cup as defined in claim 23, wherein at least a portion of said liquid proof seal is positioned above a bottom edge of said bottom of said top portion.

37. The insulated cup as defined in claim 23, wherein said top of said top portion includes a rolled rim.

38. The insulated cup as defined in claim 23, wherein said base of said base sleeve includes a recessed portion which forms a recess in said bottom of said cup.

39. The insulated cup as defined in claim 23, wherein said base sleeve and said top portion includes a paper or cardboard material.

40. The insulated cup as defined in claim 39, wherein said base sleeve includes at least one layer of corrugated material.

41. The insulated cup as defined in claim 23, wherein said insulated cup consists of only said top portion and said base sleeve.

42. An insulated cup comprising a top portion and a base sleeve that forms a bottom of the cup;

said top portion having a side wall, a top, a bottom, a top opening, a bottom opening and a cavity extending from said top opening to said bottom opening, said side wall of said top portion having an outer surface, said top portion including a side seam at least partially along a longitudinal length of said side wall of said top portion; and, said base sleeve including a base, a side wall extending upwardly from said base, an upper opening and a sleeve cavity extending from an upper surface of said base to said upper opening, said upper surface of said base sleeve at least partially forming an inner surface of said cup, said sleeve cavity having an interior surface that is absent a seam, at least a portion of said interior surface of said sleeve cavity at least partially forming said inner surface of said cup, said base sleeve fitted onto said bottom of said top portion so that said sleeve cavity of said base sleeve covers and seals said bottom opening of said top portion, at least a portion of said base sleeve connected to at least a portion of said side wall of said top portion, said connection between said base sleeve and said top portion forming a liquid proof seal, said liquid proof seal at least partially formed between said base sleeve and said side wall of said top portion, said interior surface of said base sleeve at least partially connected to said side wall of said top portion by an adhesive or heat created seal, said liquid proof seal at least partially formed by said adhesive or said heat created seal.

43. The insulated cup as defined in claim 42, wherein said side wall of said top portion having a circular cross-sectional shape that varies in cross-sectional area along a longitudinal length of said top portion, said sleeve cavity of said base sleeve having a circular cross-sectional shape that varies in cross-sectional area along a longitudinal length of said base sleeve, said sleeve cavity of said base sleeve having a similar cross-sectional shape to said cross-sectional shape of said side wall of said top portion in the region where said base sleeve and said top portion are connected together.

44. The insulated cup as defined in claim 43, wherein said side wall of said base sleeve extends upwardly less than a complete longitudinal length of said side wall of said top portion.

45. The insulated cup as defined in claim 44, wherein said base sleeve includes a coating of a sealing material.

46. The insulated cup as defined in claim 45, wherein at least a portion of said liquid proof seal is positioned above a bottom edge of said bottom of said top portion.

47. The insulated cup as defined in claim 46, wherein said top of said top portion includes a rolled rim.

48. The insulated cup as defined in claim 47, wherein said base of said base sleeve includes a recessed portion which forms a recess in said bottom of said cup.

49. The insulated cup as defined in claim 48, wherein said base sleeve and said top portion includes a paper or cardboard material.

50. The insulated cup as defined in claim 49, wherein said insulated cup consists of only said top portion and said base sleeve.

51. The insulated cup as defined in claim 42, wherein said side wall of said base sleeve extends upwardly less than a complete longitudinal length of said side wall of said top portion.

52. The insulated cup as defined in claim 42, wherein said base sleeve includes a coating of a sealing material.

53. The insulated cup as defined in claim 42, wherein at least a portion of said liquid proof seal is positioned above a bottom edge of said bottom of said top portion.

54. The insulated cup as defined in claim 42, wherein said top of said top portion includes a rolled rim.

55. The insulated cup as defined in claim 42, wherein said base of said base sleeve includes a recessed portion which forms a recess in said bottom of said cup.

56. The insulated cup as defined in claim 42, wherein said base sleeve and said top portion includes a paper or cardboard material.

57. The insulated cup as defined in claim 42, wherein said insulated cup consists of only said top portion and said base sleeve.

58. An insulated cup comprising a top portion and a base sleeve that forms a bottom of the cup;

said top portion having a side wall, a top, a bottom, a top opening and a cavity extending from said top opening to said bottom, said side wall of said top portion having an outer surface, said top portion including a side seam at least partially along a longitudinal length of said side wall of said top portion; and, said base sleeve including a base, a side wall extending upwardly from said base, an upper opening and a sleeve cavity extending from an upper surface of said base to said upper opening, said sleeve cavity having an interior surface that is absent a seam, at least a portion of said interior surface of said sleeve cavity at least partially forming said inner surface of said cup, said base sleeve fitted onto said bottom of said top portion so that said sleeve cavity of said base sleeve covers said bottom of said top portion, at least a portion of said base sleeve connected to at least a portion of said side wall of said top portion, said connection between said base sleeve and said top portion forming a liquid proof seal, said liquid proof seal at least partially formed between said base sleeve and said side wall of said top portion, said interior surface of said base sleeve at least partially connected to said side wall of said top portion by an adhesive or heat created seal, said liquid proof seal at least partially formed by said adhesive or said heat created seal.

59. The insulated cup as defined in claim 58, wherein said base sleeve and said top portion includes a paper or cardboard material.

60. The insulated cup as defined in claim 59, wherein said base sleeve includes at least one layer of corrugated material.

61. The insulated cup as defined in claim 60, wherein said base sleeve includes multiple layers.

62. The insulated cup as defined in claim 61, wherein said side wall of said top portion having a circular cross-sectional shape that varies in cross-sectional area along a longitudinal length of said top portion, said sleeve cavity of said base sleeve having a circular cross-sectional shape that varies in cross-sectional area along a longitudinal length of said base sleeve, said sleeve cavity of said base sleeve having a similar cross-sectional shape to said cross-sectional shape of said side wall of said top portion in the region where said base sleeve and said top portion are connected together.

63. The insulated cup as defined in claim 62, wherein said side wall of said base sleeve extends upwardly less than a complete longitudinal length of said side wall of said top portion.

64. The insulated cup as defined in claim 63, wherein said top of said top portion includes a rolled rim.

65. The insulated cup as defined in claim 64, wherein said insulated cup consists of only said top portion and said base sleeve.

66. The insulated cup as defined in claim 58, wherein said side wall of said top portion having a circular cross-sectional shape that varies in cross-sectional area along a longitudinal length of said top portion, said sleeve cavity of said base sleeve having a circular cross-sectional shape that varies in cross-sectional area along a longitudinal length of said base sleeve, said sleeve cavity of said base sleeve having a similar cross-sectional shape to said cross-sectional shape of said side wall of said top portion in the region where said base sleeve and said top portion are connected together.

67. The insulated cup as defined in claim 58, wherein said side wall of said base sleeve extends upwardly less than a complete longitudinal length of said side wall of said top portion.

68. The insulated cup as defined in claim 58, wherein said top of said top portion includes a rolled rim.

69. The insulated cup as defined in claim 58, wherein said insulated cup consists of only said top portion and said base sleeve.

* * * * *